US008362857B2

(12) United States Patent
Tsutsui et al.

(10) Patent No.: US 8,362,857 B2
(45) Date of Patent: Jan. 29, 2013

(54) CONTACT SWITCH STRUCTURE AND ELECTROMAGNETIC RELAY

(75) Inventors: Kazuhiro Tsutsui, Nagano (JP); Jun Sasaki, Yamaga (JP); Yoshiaki Mimura, Kikuchi (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/016,591

(22) Filed: Jan. 28, 2011

(65) Prior Publication Data

US 2011/0221549 A1 Sep. 15, 2011

(30) Foreign Application Priority Data

Mar. 12, 2010 (JP) ..... 2010-05621 6

(51) Int. Cl.
*H01H 51/22* (2006.01)

(52) U.S. Cl. ..... 335/78; 335/83

(58) Field of Classification Search ..... 335/78, 335/83

See application file for complete search history.

(56) References Cited

U.S. PATENT DOCUMENTS

| | | | | |
|---|---|---|---|---|
| 4,267,540 | A * | 5/1981 | Iketani | 335/128 |
| 4,827,232 | A * | 5/1989 | Minks | 335/78 |
| 4,857,872 | A * | 8/1989 | Bassino | 335/80 |
| 5,319,331 | A * | 6/1994 | Hirawata et al. | 335/78 |
| 5,781,089 | A * | 7/1998 | Doneghue | 335/78 |
| 5,990,770 | A * | 11/1999 | Doneghue | 335/78 |
| 6,489,868 | B1 * | 12/2002 | Sato et al. | 335/78 |
| 6,621,394 | B2 * | 9/2003 | Ono et al. | 335/159 |
| 6,903,638 | B2 * | 6/2005 | Nakamura et al. | 335/78 |
| 7,283,026 | B2 * | 10/2007 | Nakamura et al. | 335/78 |
| 7,335,040 | B2 * | 2/2008 | Ota et al. | 439/188 |
| 2002/0036556 | A1 * | 3/2002 | Matsuda | 335/78 |
| 2004/0119566 | A1 | 6/2004 | Sanada et al. | |

FOREIGN PATENT DOCUMENTS

| | | | |
|---|---|---|---|
| DE | 29510900 | U1 | 9/1995 |
| JP | 03-088246 | U | 9/1991 |
| JP | 2004-164949 | A | 6/2004 |

OTHER PUBLICATIONS

European Search Report for Application No. 10196562.2 dated Jun. 28, 2011 (5 pages).

Johler, W et al, E&I Elektrotechnik Und Informationstechnik,vol. 107 No. 2 "Reinigung Von Kontakten Fur Signalrelais", XP000099521, Wien, AT, Jan. 1, 1990 (5 pages).

Korean Examination Report for Application No. 10-2011-0011694, mailed on Jan. 20, 2012 (6 pages).

* cited by examiner

*Primary Examiner* — Alexander Talpalatski
(74) *Attorney, Agent, or Firm* — Osha Liang LLP

(57) ABSTRACT

A contact switch structure has a touch piece, a movable contact disposed on the touch piece, a fixed contact disposed opposite the movable contact, and a guide unit that is provided in a side region with respect to an operating range of the movable touch piece to control an air flow. The movable contact is opened and closed with respect to the fixed contact by operating the movable touch piece.

6 Claims, 11 Drawing Sheets

CONTACT SWITCH STRUCTURE AND ELECTROMAGNETIC RELAY

BACKGROUND OF THE INVENTION

1. Technical Field

The present invention relates to a contact switch structure and an electromagnetic relay provided with the contact switch structure.

2. Related Art

Conventionally, there is well known an electromagnetic relay, in which an excitation coil disposed around a fixed iron core is excited or demagnetized to attract or separate an armature to and from the fixed iron core, a movable touch piece attached to the armature is operated to open and close a movable contact provided in the movable touch piece with respect to a fixed contact disposed in an opposite position (for example, see Japanese Utility Model Publication Laid-Open No. 3-88246).

In the electromagnetic relay, in forming components such as the armature and the excitation coil, flash and burrs are generated or micro chips adheres to the components, and the flash, burrs and micro chips may remain as floating fine particles (diameter of about 20 μm). When the fine particle adheres to a surface of the contact, a contact resistance of the contact may be increased, or faulty electrical continuity may be generated in some cases. Therefore, after the flash and burrs are removed from each component or the component is cleaned, the further cleaning is also performed after assembly to prevent the generation of the fine particle, thereby enhancing contact reliability of the contact.

However, the generation of the fine particle cannot completely be prevented by the cleaning. Therefore, when the contact is opened from a closed state, air flows between the contacts from the surroundings, and possibly the flying fine particle adheres to the surface of the contact.

There is also proposed a method for increasing the number of poles of the contact (the contact is switched in multi-pole-to-multi-pole manner) in order to enhance the contact reliability of the contact. However, unfortunately an occupied space of the contact switch mechanism is increased, thus causing enlargement of the device.

SUMMARY

One or more embodiments of the present invention provides a compact contact switch structure having the high contact reliability of the contact and an electromagnetic relay provided with the contact switch structure.

In accordance with one aspect of the invention, a contact switch structure in which a movable contact is opened and closed with respect to a fixed contact disposed in an opposite position by operating a movable touch piece provided with the movable contact, and the contact switch structure includes a guide unit that is provided in a side region with respect to an operating range of the movable touch piece to control an air flow.

That is, when the movable touch piece is operated, the air flow is generated in a region opposite the contact and a neighborhood of the region. The air flow becomes imbalanced by action of the guide unit with respect to a closed position of the contact. Particularly, when the guide unit is formed such that the whole side region of the operating range of the movable touch piece is covered with the guide unit, the air flow from a direction of the side region can be substantially controlled at a time of opening the contact. Therefore, the concentration of the air flow on the contact closed position can effectively be prevented.

According to one or more embodiments of the present invention, even if the movable touch piece is operated to open the contact from the closed state, the air flow in the region opposite the contact is oriented toward the guide unit by the action of the guide unit. Accordingly, even if the air includes the fine particle, since the fine particle moves along with the air flow by the action of the guide unit, the fine particle does not adhere to the center of the contact surface that is of the contact position of the fixed contact and the movable contact. That is, the contact resistance of the contact may not be increased, or faulty electrical continuity may not be generated. Therefore, the desired contact reliability can be maintained in the contact. Accordingly, it is not necessary to increase the number of poles of the contact, and the enlargement of the device can be prevented.

According to one or more embodiments of the present invention, the guide unit is formed such that a linear distance to an operating locus of the movable touch piece becomes 0.8 mm or less, and a linear distance to a wall opposite the operating locus of the movable touch piece in a space formed between the movable touch piece and an opposite side of the guide unit exceeds 0.8 mm. Particularly the distance of 0.4 mm is optimum.

According to one or more embodiments of the present invention, the air flow in the region opposite the contact is oriented toward the guide unit, and the adhesion of the fine particle to the contact position of the contact is largely or completely prevented.

In accordance with another aspect of the invention, an electromagnetic relay in which a movable contact is opened and closed with respect to a fixed contact such that a movable iron piece is turned to drive a movable touch piece by establishing or blocking electric conduction of an electromagnet unit in which a coil is wound around an iron core with a spool interposed therebetween through the coil to excite or demagnetize the electromagnet unit, and the electromagnetic relay includes a guide unit that is located in at least a side region with respect to an operating range of the movable touch piece.

According to one or more embodiments of the present invention, the guide unit is partially formed by a coil terminal attaching portion formed in a guard portion of the spool.

According to one or more embodiments of the present invention, the guide unit can be formed only by slightly changing the already-existing structure of the coil terminal attaching portion, without largely changing the structure.

According to one or more embodiments of the present invention, the guide unit is formed such that a linear distance to an operating locus of the movable touch piece becomes 0.8 mm or less, and a linear distance to a wall opposite the operating locus of the movable touch piece in a space formed between the movable touch piece and an opposite side of the guide unit exceeds 0.8 mm.

According to one or more embodiments of the invention, since the guide unit is formed in the side region with respect to the operating range of the movable touch piece, the air flow in the side region can be controlled and the air flow is not concentrated on the contact switch region. Accordingly, even if the air includes the fine particle, the fine particle can properly be prevented from adhering to the contact surface.

DETAILED DESCRIPTION

Embodiments of the invention will be described below with reference to the drawings. Hereinafter, terms indicating a particular direction or position (for example, terms including "up", "down", "side", and "end") are used if needed. The terms are used to facilitate understanding of the invention through the drawings, and the technical scope of the invention is not limited to the meanings of the terms. The embodiments are described only by way of example, and it is understood that the embodiments do not restrict the invention, applications of the invention, and use of the invention. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

(1. Configuration)

Figure 1:
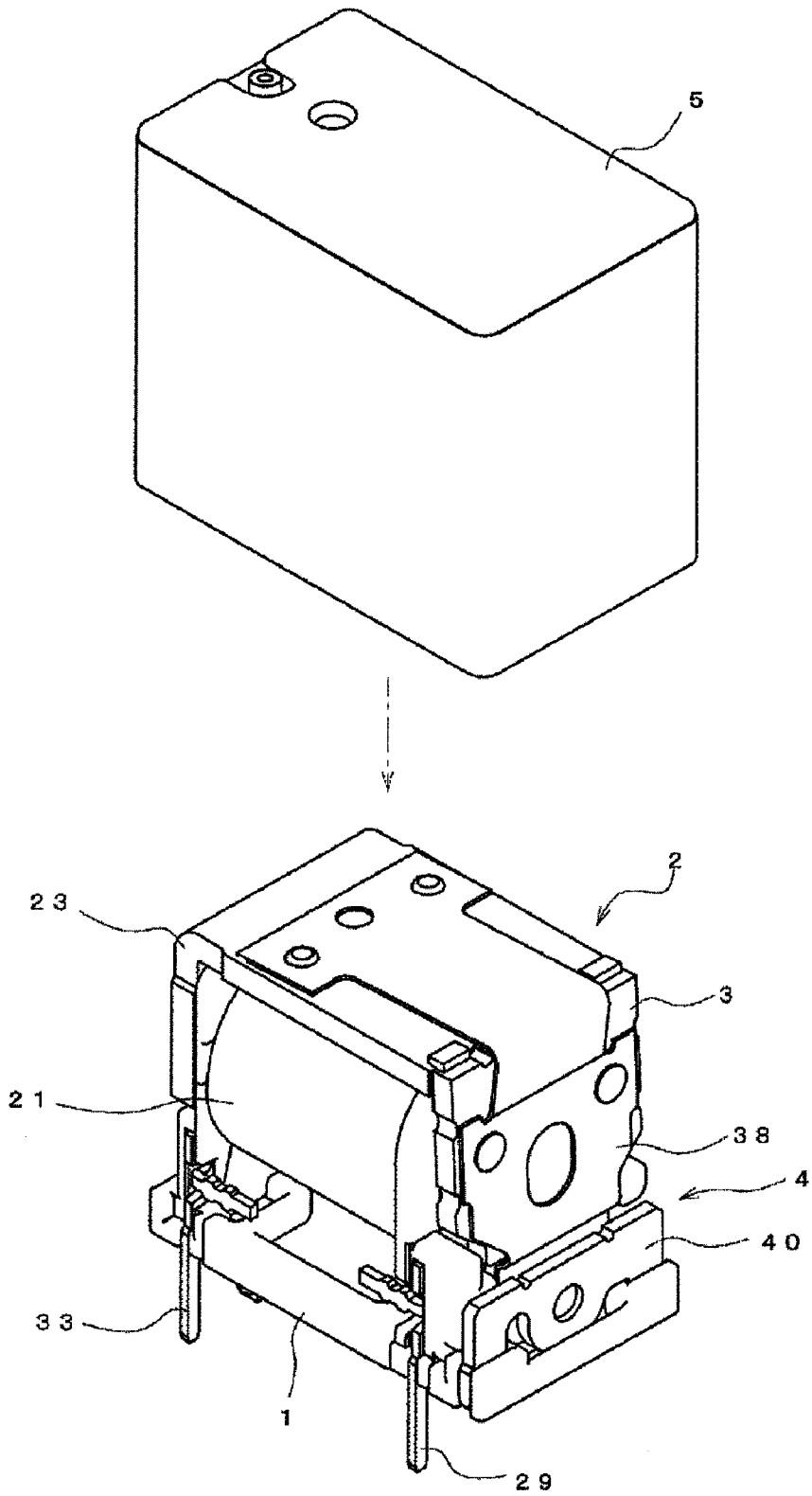
FIG. 1 is a perspective view illustrating a state in which only a case of an electromagnetic relay according to an embodiment of the invention is taken a part.
Figure 2:
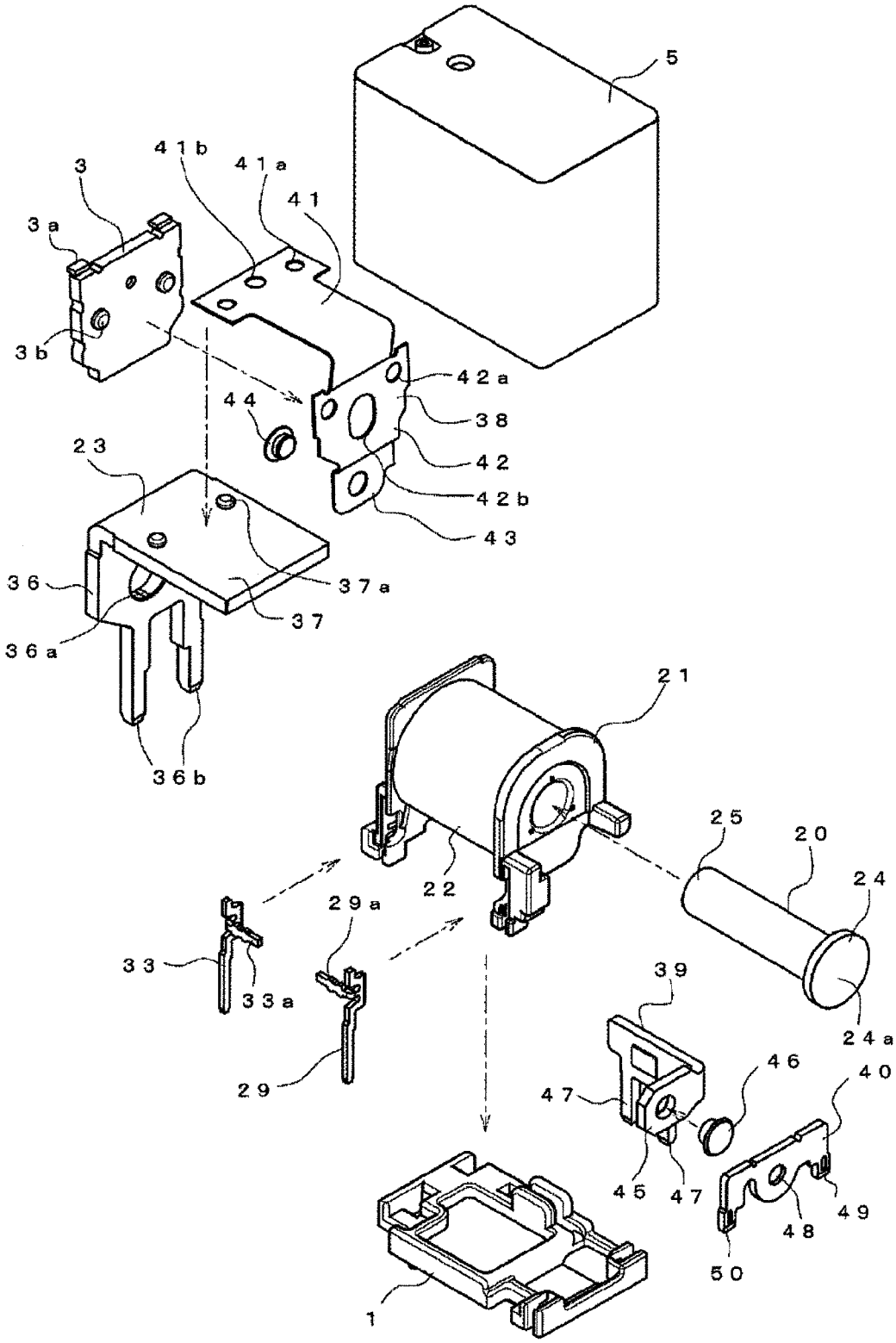
FIG. 2 is an exploded perspective view of the electromagnetic relay.

FIGS. 1 and 2 are illustrating an electromagnetic relay according to an embodiment of the invention. The electromagnetic relay roughly has a configuration in which an electromagnet unit 2, a movable iron piece 3, and a contact switch mechanism 4 are covered with a case 5 while the electromagnet unit 2, the movable iron piece 3, and the contact switch mechanism 4 are provided on a base 1.

(1-1. Base 1)

Figure 3A:
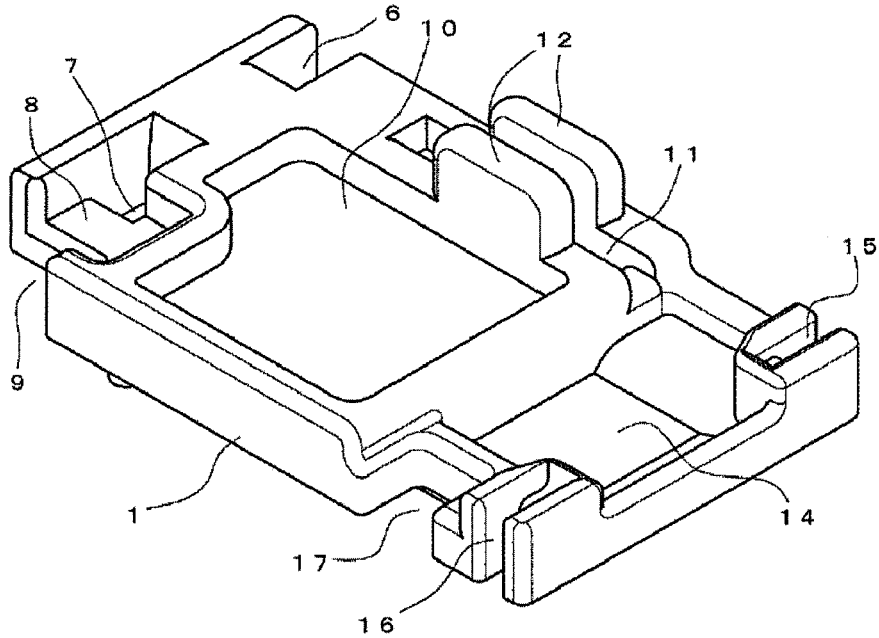
FIG. 3A is an enlarged perspective view of a base of FIG. 2.
Figure 3B:
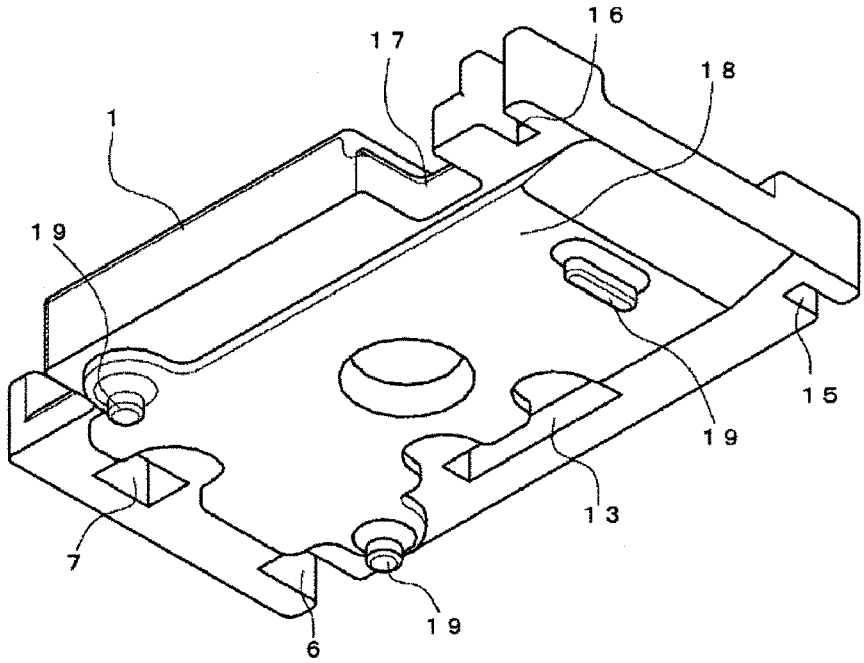
FIG. 3B is a perspective view illustrating the base when viewed from a bottom surface side.

As illustrated in FIG. 3A, the plate-like base 1 is formed into a substantially rectangular shape by molding a synthetic resin material. A first notch 6 and a first rectangular hole 7 are made on both sides at one end of the base 1, and legs 36*b* of a yoke 23 are inserted in the first notch 6 and the first rectangular hole 7. A first recess 8 is formed in a side portion of the first rectangular hole 7. A second notch 9 is formed in a side portion of the first recess 8. A part of a spool 21 (a second terminal attaching portion 34) and a second coil terminal 33 are disposed in the second notch 9. A second recess 10 is formed in a central portion of the base 1 in order to generate a shrinkage in molding or to suppress a material. A guide groove 11 and a pair of guide walls 12 are formed in a side portion of the second recess 10, and the guide walls 12 are disposed opposing each other so as to interpose the guide groove 11 therebetween. A second rectangular hole 13 is made in a bottom surface of the guide groove 11. A third recess 14 that is lower than the second recess 10 is formed on the other end side of the base 1, and a third notch 15, a fourth notch 16 and a fifth notch 17 are formed in both side portions of the third notch 14. The third notch 15 is laterally opened, and the fourth notch 16 and the fifth notch 17 are laterally opened. As illustrated in FIG. 3B, a step portion 18 is formed in the bottom surface of the base 1. The step portion is projected except a peripheral portion, and stand-offs 19 are formed at three points in the projected step portion. The stand-off 19 forms a predetermined gap with a circuit board when the electromagnetic relay is mounted on a circuit board (not illustrated).

(1-2. Electromagnet Unit 2)

In the electromagnet unit 2, as illustrated in FIG. 2, a coil 22 is wound around an iron core 20 with the spool 21 interposed therebetween, and the yoke 23 is integrally formed.

The iron core 20 made of a magnetic material is formed into a substantially cylindrical shape, an attracting portion 24 whose outer diameter is increased is formed at one end of the iron core 20, and the other end constitutes a connection portion 25 that is rigidly swaged to the yoke 23.

Figure 4A:
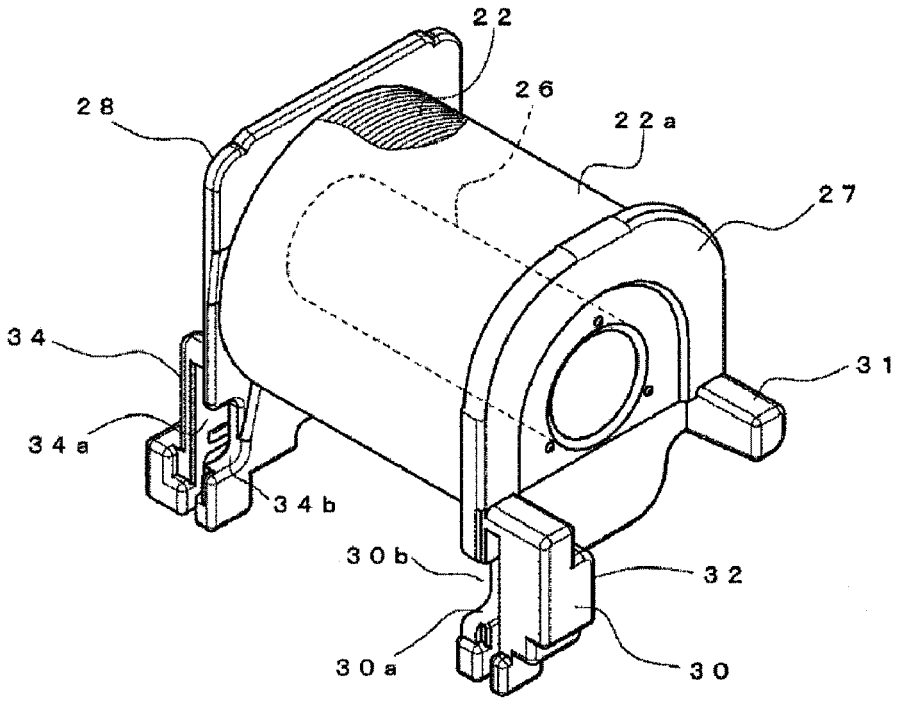
FIG. 4A is an enlarged perspective view of a spool of FIG. 2.
Figure 4B:
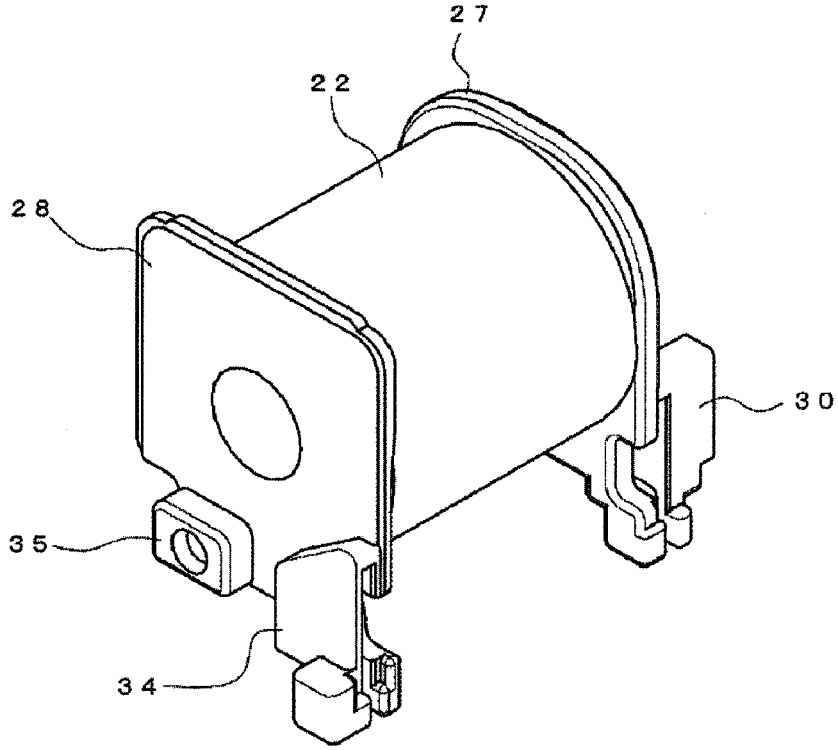
FIG. 4B is a perspective view illustrating the base when viewed from a different angle.
Figure 5:
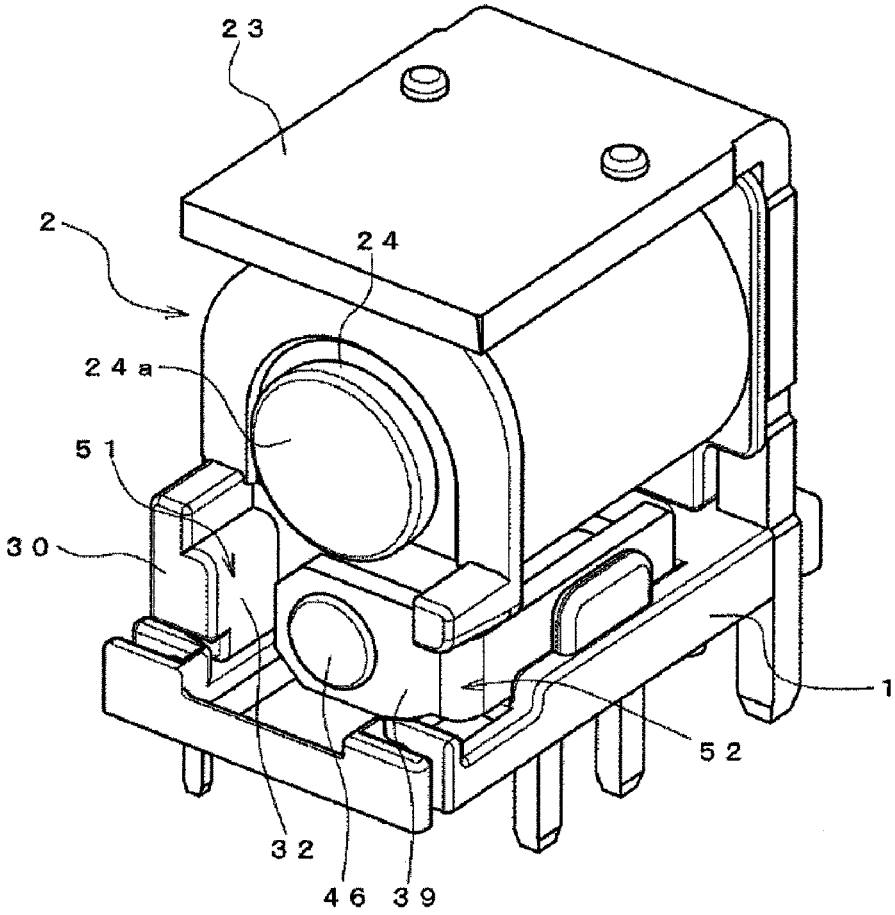
FIG. 5 is a partially perspective view illustrating a characteristic portion of the electromagnetic relay.

The spool 21 is formed by molding the synthetic resin material. As illustrated in FIG. 4A, the spool 21 includes a cylindrical portion 26, a first guard portion 27, and a second guard portion. The iron core 20 is inserted in the cylindrical portion 26, and the coil 22 (not illustrated) is wound around the cylindrical portion 26. The first guard portion 27 and the second guard portion 28 are formed in both end portions of the cylindrical portion 26, respectively. A first terminal attaching portion 30 that is used to attach a first coil terminal 29 and a projection 31 are formed on both sides of the first guard portion 27, respectively. In the first terminal attaching portion 30, an inner surface portion (plat portion on the side of the projection 31) is widened, and a guide surface 32 is formed so as to be located in at least a side portion of a moving range of the movable touch piece 38 (not illustrated). A vertically long slit 30*a* and an escape portion 30*b* are formed in the first terminal attaching portion 30. The slit 30*a* is laterally opened. The slit 30*a* and the escape portion 30*b* are continuously formed, and the escape portion is opened on the side of the cylindrical portion 26. The first coil terminal 29 is press-fitted in the slit 30*a* from the lateral side. The projection 31 is provided so as to be grasped by a robot arm (not illustrated) when the electromagnet unit 2 is assembled in the base 1. As illustrated in FIG. 4B, the second terminal attaching portion 34 that is used to attach the second coil terminal 33 and a guide projection 35 are formed in the second guard portion 28. Similarly to the first terminal attaching portion 30, a slit 34*a* and an escape portion 34*b* are formed in the second terminal attaching portion 34. The second coil terminal 33 is press-fitted in the slit 34*a*. The first coil terminal 29 and the second coil terminal 33 have the similar configurations. As illustrated in FIG. 2, a twist portion 33*a* and a twist portion 29*a* are formed on the upper sides of the first coil terminal 29 and the second coil terminal 33, respectively. The twist portion 33*a* is laterally bent, and the twist portion 33*a* is folded after one end of the coil 22 is twisted in the twist portion 33*a*, whereby the twist portion 33*a* is located in the escape portion 34*b*. The twist portion 29*a* is laterally bent, and the twist portion 29*a* is folded after one end of the coil 22 is twisted in the twist portion 29*a*, whereby the twist portion 29*a* is located in the escape portion 30*b*. When the electromagnet unit 2 is assembled in the base 1, the guide projection 35 abuts on the upper surface of the base 1 to position the electromagnet unit 2 in the base 1.

The coil 22 is wound around the cylindrical portion 26 of the spool 21, one end of the coil 22 is twisted in the first coil terminal 29, and the other end is twisted in the second coil terminal 33.

As illustrated in FIG. 2, in the yoke 23, a plate made of the magnetic material is bent into a substantial L-shape to form a first flat plate portion 36 and a second flat plate portion 37. A fitting hole 36*a* is made in the central portion of the first flat plate portion 36 to fix the connection portion 25 of the iron core 20 in the fitting hole 36. The legs 36*b* divided into two are formed at a leading end of the first flat plate portion 36. The legs 36*b* fix the yoke 23 to the base 1, and the legs 36*b* act as a terminal that energizes the movable touch piece 38. Projections 37*a* are formed at two points in a width direction in the upper surface of the second flat plate portion 37, and the projections 37*a* are used to swage the movable touch piece 38 (illustrated later).

(1-3. Movable Iron Piece 3)

As illustrated in FIG. 2, the movable iron piece 3 is formed by a plate made of the magnetic material, and latching pawls 3*a* are formed on both sides at upper end of the movable iron piece 3. Projections 3*b* are formed at two points in the width direction in one of surfaces of the movable iron piece 3 (a surface on the opposite side to the abutment side on to the yoke 23), and the projections 3*b* are inserted and swaged in through-holes 42*a* of the movable touch piece 38.

(1-4. Contact Switch Mechanism 4)

As illustrated in FIG. 2, the contact switch mechanism 4 includes the movable touch piece 38, a fixed terminal 39, and a dummy terminal 40.

In the movable touch piece 38, a conductive metallic plate (such as a plate spring) having elasticity is bent into a substantial L-shape to form a first planar portion 41 and a second planar portion 42. The first planar portion 41 is formed into a substantial T-shape, first through-holes 41*a* are made on both sides in a leading end portion of the first planar portion 41, and a second through-hole 41*b* is made between the first through-holes 41*a*. The projection 37*a* of the yoke 23 is inserted and swaged in the first through-hole 41*a*. The second through-hole 41*b* is used in order that the robot arm or the like (not illustrated) retains the movable touch piece 38 when the movable touch piece 38 is assembled in the yoke 23. In the first planar portion 42, through-holes 42*a* are made on at two points both sides of the first planar portion 41 in order to rigidly swage the projection 3*b* of the movable iron piece 3, and an opening 42*b* is made in the central portion. A width is narrowed on the leading end side of the second planar portion 42, the second planar portion 42 is bent along the lower end portion of the movable iron piece 3, and a movable contact 44 is rigidly swaged into a movable contact portion 43 in the leading end portion of the second planar portion 42.

In the fixed terminal 39, a conductive metallic plate is bent into a substantial L-shape. A fixed contact 46 is swaged in a fixed contact portion 45 at one end of the fixed contact 39, and a pair of terminal portions 47 is formed at the other end. The terminal portions 47 extend downward with a predetermined gap. The reason the pair of terminal portions 47 is formed is to deal with the case when a large current is applied.

In the dummy terminal 40, a contact receiving portion 48 is projected from the central portion of the metallic plate, a first leg 49 and a second leg 50 are formed in both end portions. The first leg 49 and the second leg 50 extend downward. The first leg 49 is press-fitted in the third notch 15 of the base 1 while the second leg 50 is press-fitted in the fourth notch 16, thereby attaching the dummy terminal 40 to the base 1.

(1-5. Case 5)

The case 5 is formed into a box shape whose lower surface is opened by molding the synthetic resin material. The case 5 is fitted in the outer peripheral surface of the base 1 where the components are mounted thereon. In the fitting state, a recess portion is formed by a recess that is formed in a peripheral portion by forming the step portion 18 in the bottom surface of the base 1 and a lower end opening edge portion of the base 1. A sealing agent is injected in the recess portion to seal the gap between the terminals projected from the lower surface of the base 1.

(2. Producing Method)

A method for producing the electromagnetic relay according to one or more embodiments of the present invention will be described below.

The electromagnet unit is formed.

In forming the electromagnet unit 2, the coil 22 is wound around the cylindrical portion 26 of the spool 21. The iron core 20 is inserted in the cylindrical portion 26. The first coil terminal 29 is press-fitted in the first terminal attaching portion 30 of the spool 21, and the second coil terminal 33 is press-fitted in the second terminal attaching portion 34. One end portion of the coil 22 is twisted in the twist portion 29*a* of the first coil terminal 29, and the other end portion of the coil 22 is twisted in the twist portion 33*a* of the second coil terminal 33. The twist portions 29*a* and 33*a* of the coil terminals 29 and 33 are folded and located in the escape portions 30*b* and 34*b* of the spool 21, and the twist portions 29*a* and 33*a* are provided along the outer peripheral surface of the wound coil 22. The connection portion 25 of the iron core 20 is fitted and swaged in the fitting hole 36*a* made in the first flat plate portion 36 of the yoke 23.

The terminal portion 47 of the fixed terminal 39 is press-fitted in the second rectangular hole 13 of the base 1, and the terminal portion 47 is guided by the guide groove 11 and the guide wall 12. Not only the fixed terminal 39 is press-fitted in the second rectangular hole 13, but also the fixed terminal 39 is strongly guided by the guide groove 11 and the guide wall 12. Accordingly, even if the fixed contact 39 is subject to shock during product delivery, position deviation is not generated in the fixed contact 39. The first leg 49 and the second leg 50 are press-fitted in the fourth notch 16 and the fifth notch 17, respectively, and the contact receiving portion 48 of the dummy terminal 40 is located opposite the fixed terminal 46 of the fixed terminal 39 with a predetermined gap.

The electromagnet unit 2 is attached to the base 1.

In attaching the electromagnet unit 2, the legs 36*b* are press-fitted in the first notch 6 and the first rectangular hole 7, the second terminal attaching portion 34 of the spool 21 is disposed in the second notch 9 of the base 1, and the first terminal attaching portion 30 of the spool 21 is disposed in the fifth notch 17.

The projection 3*b* of the movable iron piece 3 is inserted and swaged in the through-hole 42*a* of the movable touch piece 38. Then the latching pawl 3*a* of the movable iron piece 3 is latched at the leading end of the second flat plate portion 37 of the yoke 23, thereby supporting turnably the movable iron piece 3. The projections 37*a* of the yoke 23 are inserted and swaged in the through-holes 41*a* and 42*a* of the movable touch piece 38, whereby the movable touch piece 38 is attached to couple the yoke 23 and the movable iron piece 3. At this point, the movable iron piece 3 is separated from an end face (attracting surface 24*a*) of the attracting portion 24 of the iron core 20 by an elastic force possessed by the movable touch piece 38. At this point, the second planar portion 42 is activated such that the movable touch piece 38 abuts the movable contact 44 on the movable contact portion 43 of the dummy terminal 40 using a spring force of the movable touch piece 38. Therefore, the movable iron piece 3 is separated from the attracting surface 24*a* of the iron core 20. The guide surface 32 formed in the first guard portion 27 of the spool 21 is located in one of side portions (a first side portion 51 illustrated in FIG. 6) of the movable contact portion 43 of the movable touch piece 38. The shortest distance between the guide surface 32 and the movable touch piece 38 (distance between the guide surface 32 and a moving locus surface at one of side edges of the movable touch piece 38) is set to 0.6 mm or less. A gap that exceeds at least the shortest distance to the guide surface 32 is formed in the other side portion of the movable contact portion 43 of the movable touch piece 38 (a second side portion 52 on the opposite side to the guide surface 32). Therefore, the flow of the air flowing into the opposite region from the surroundings becomes imbalanced in switching the contact. That is, when the contact is opened, the guide surface side becomes a negative pressure to generate the air flow from the second side portion 52 toward the first side portion 51. On the other hand, when the contact is closed, the guide surface 32 blocks the air flow to generate the air flow from the first side portion 51 toward the second side portion 52. As a result, even if a foreign matter (micro dust or burr) is included in the air flowing between the contacts, the air is not concentrated on the central contact opposite region, and a probability that the foreign matter adheres to the contact surface is largely reduced or eliminated.

Operating states of the movable iron piece 3 and movable touch piece 38 are inspected.

The movable iron piece 3 is pressed through the opening formed in the second planar portion 42 of the movable touch piece 38 using a jig (not illustrated), and the movable iron piece is abutted on the attracting surface of the iron core 20. At this point, whether the electric conduction is established between the movable touch piece 38 and the fixed terminal 39, that is, whether the contact is properly closed is detected.

The base 1 is covered with the case 5. The recess formed between the opening edge portion of the case 5 and the step portion 18 of the base 1 is filled with the sealing agent, and a gaps between each terminal and the base, each terminal and the case 5, and the case 5 and the base 1 is sealed to complete the electromagnetic relay.

(3. Operation)

An operation of the electromagnetic relay according to one or more embodiments of the present invention will be described below.

While the electromagnet unit 2 is demagnetized before the current is passed through the coil 22, the movable iron piece 3 abuts the movable contact 44 on the contact receiving portion 48 of the dummy terminal 40 by the spring force of the movable touch piece 38. Accordingly, the movable contact 44 is located opposite the fixed contact 46 with a predetermined gap.

When the current is passed through the coil 22 to excite the electromagnet unit 2, the movable iron piece 3 is attracted to the attracting portion 24 of the iron core 20. The movable touch piece 38 is driven along with the movable iron piece 3 and the movable contact 44 comes into contact with the fixed contact 46.

Figure 6A:
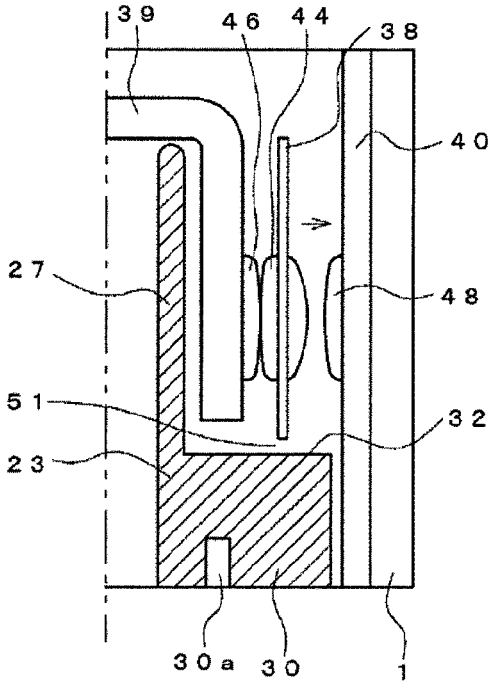
FIG. 6A is a partially plan view (partially sectional) of FIG. 5.
Figure 6B:
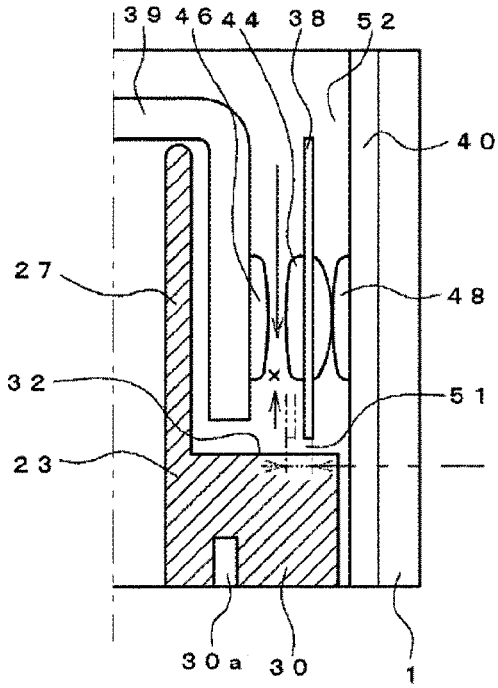
FIG. 6B is a view illustrating a state in which a movable touch piece is operated from FIG. 6A.

When the passage of the current through the coil 22 is cut off to demagnetize the electromagnet unit 2, the attraction force of the attracting portion 24 of the iron core 20 is eliminated, and the movable touch piece 38 is returned from the position illustrated in FIG. 6A to the original position illustrated in FIG. 6B by the spring force possessed by the movable touch piece 38. At this point, the opposite region of the contact becomes the negative pressure, and the air flow in the opposite region of the contact from the surrounding. However, the guide surface 32 is located near the side portion of the movable touch piece 38. Therefore, in opening the contact, the air flow that can be sucked cannot be formed on the side of the first side portion 51 (guide surface 32), and the negative pressure is generated. Accordingly, as illustrated in FIG. 6B, the air mainly flows from the side of the second side portion 52, and the air flow is not concentrated on the opposite region of the contact (the air flow is concentrated on the position indicated by "X" of FIG. 6B). That is, even if the fine particle floats in the air, the possibility that the fine particle remains in the opposite region of the contact to adhere to the contact surface becomes extremely low.

Figure 13A:
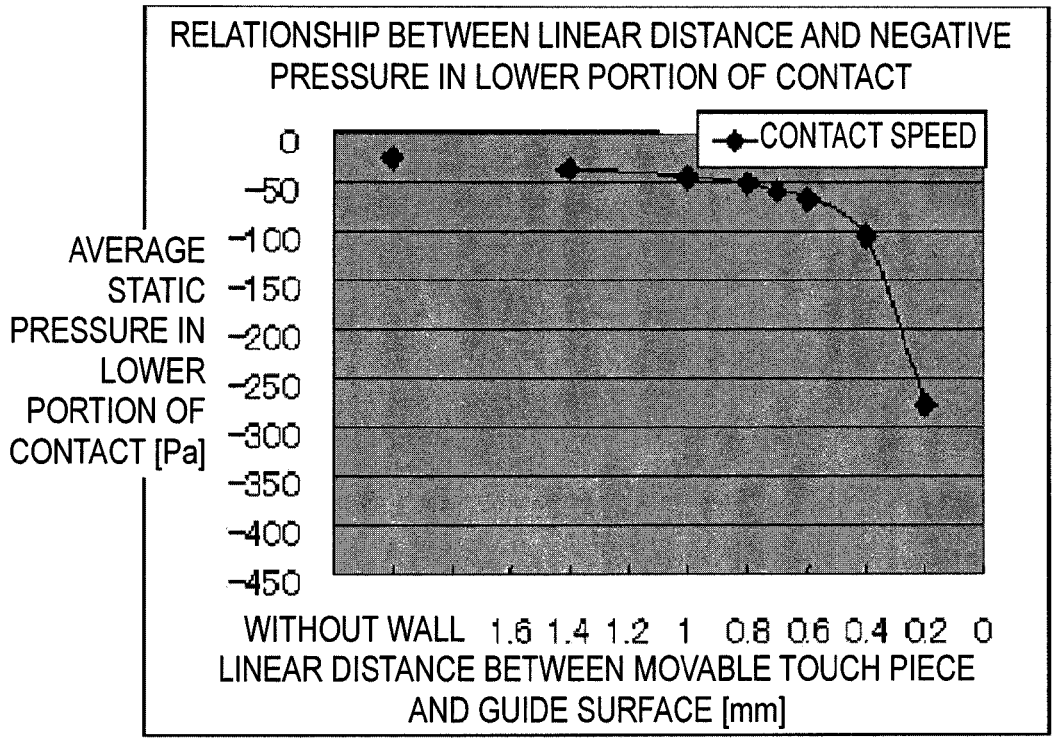
FIGS. 13A and 13B are views illustrating an air flow in a contact switch region.
Figure 13B:
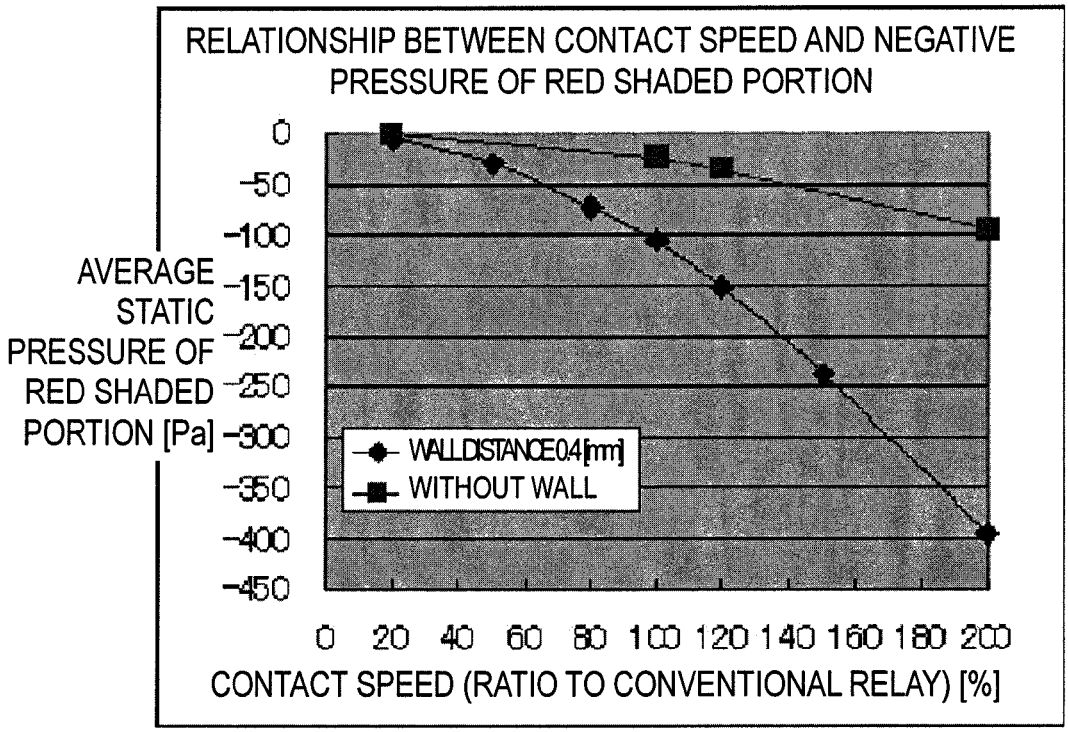
Figure 14:
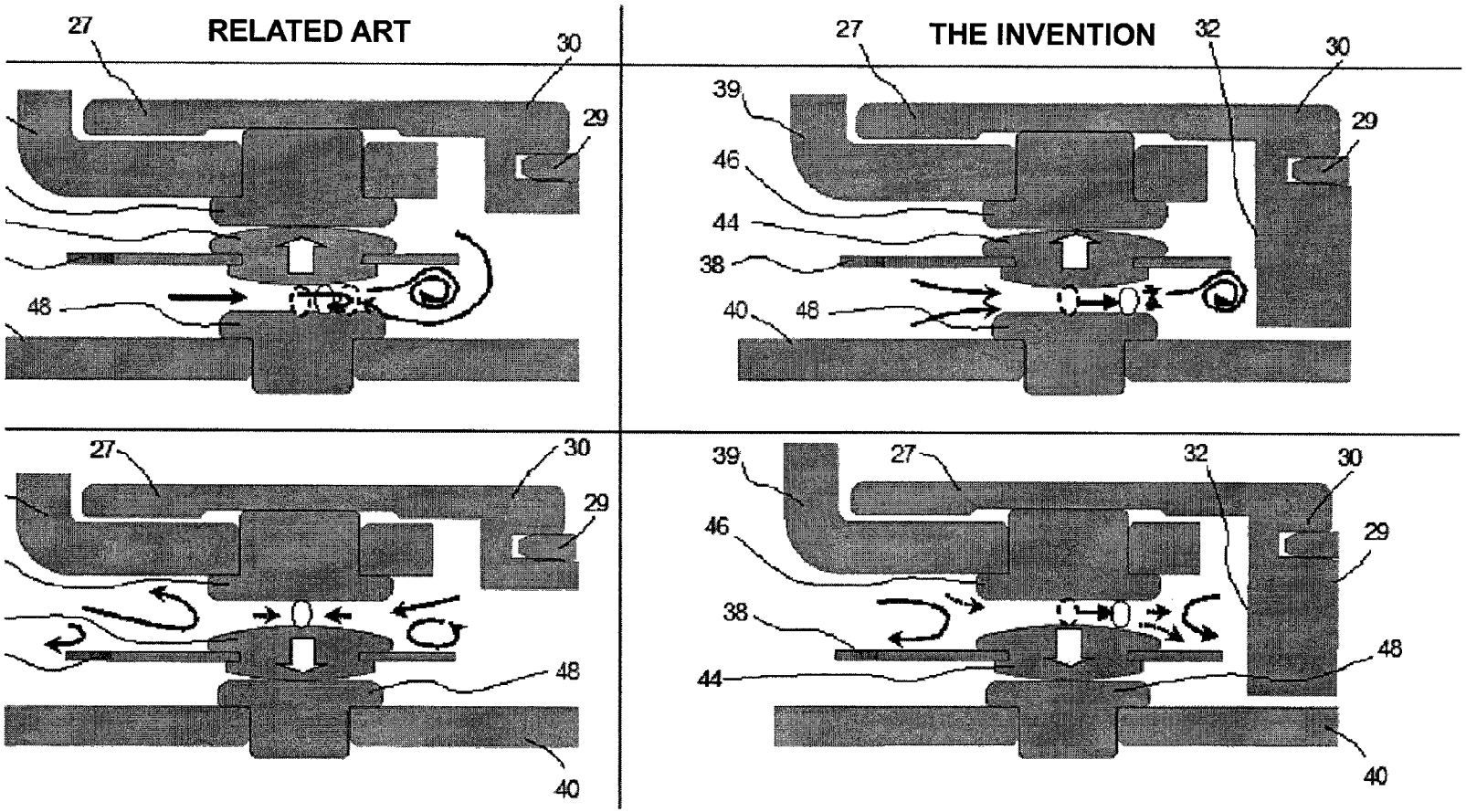
FIG. 14 is a graph illustrating a simulation result of the air flow in the contact switch region.

FIGS. 13A, 13B, and 14 are graphs illustrating simulation results of the air flow in the contact switch region.

FIG. 13A is a graph illustrating the simulation result of a relationship between a linear distance (shortest distance) from the operating locus of the movable touch piece 38 to the guide surface 32 and an air pressure (average static pressure in a lower portion of the contact) when the movable touch piece 38 is operated in the contact switch region. As is clear from the graph, as the linear distance is shortened, the air pressure is decreased on the side on which the guide surface 32 is disposed in both side portions of the movable touch piece 38. Particularly, the air pressure is decreased (negative pressure) on the side of the guide surface 32 when the linear distance is about 0.8 mm, and the air pressure is prominently changed when the linear distance is 0.4 mm.

FIG. 13B is a graph illustrating the simulation result of a relationship between an operating speed (contact switching speed) of the movable touch piece 38 and the air pressure when the linear distance is 0.4 mm. As is clear from the graph, as the operating speed of the movable touch piece 38 is increased, a degree of decrease of the air pressure becomes larger than that of the related art (the guide surface 32 is not provided).

FIG. 14 illustrates the air flow in the contact switch region based on the result of FIGS. 13A and 13B. That is, in the conventional configuration, the fine particle flows toward the center of the contact switch region. On the other hand, according to one or more embodiments of the present invention, the guide surface 32 is formed along the operating locus of the movable touch piece 38 to generate the air flow toward the side of the guide surface 32, whereby the fine particle flows so as to move away from the contact switch region.

(4. Other Embodiments)

In one or more embodiments of the present invention, the guide unit is formed by a part of the spool 21. Alternatively, for example, the guide unit can be formed another component.

Figure 7:
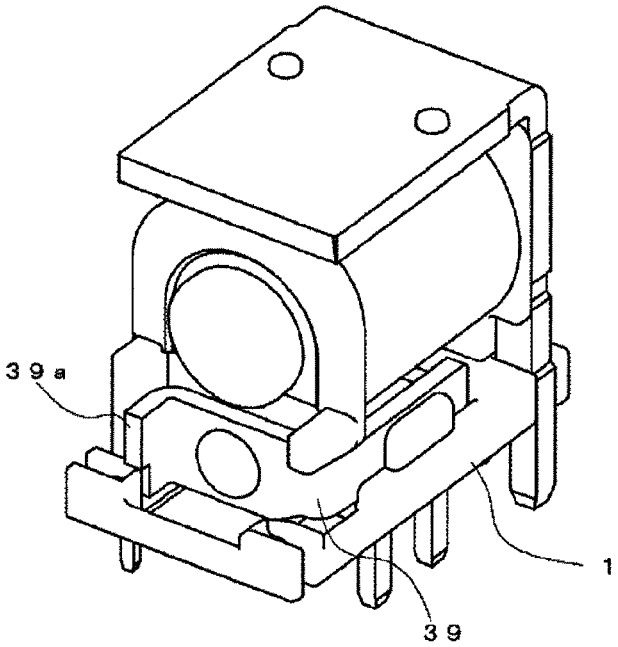
FIG. 7 is a partially perspective view illustrating a characteristic portion of an electromagnetic relay according to another embodiment of the invention.

FIG. 7 illustrates an example in which the guide unit is formed by part of the fixed terminal 39.

In the fixed terminal 39, the leading end of the fixed contact portion 45 is further bent at a right angle, and a guide piece 39*a* is formed so as to extend toward the side region of the operating range of the movable touch piece 38.

Figure 8:
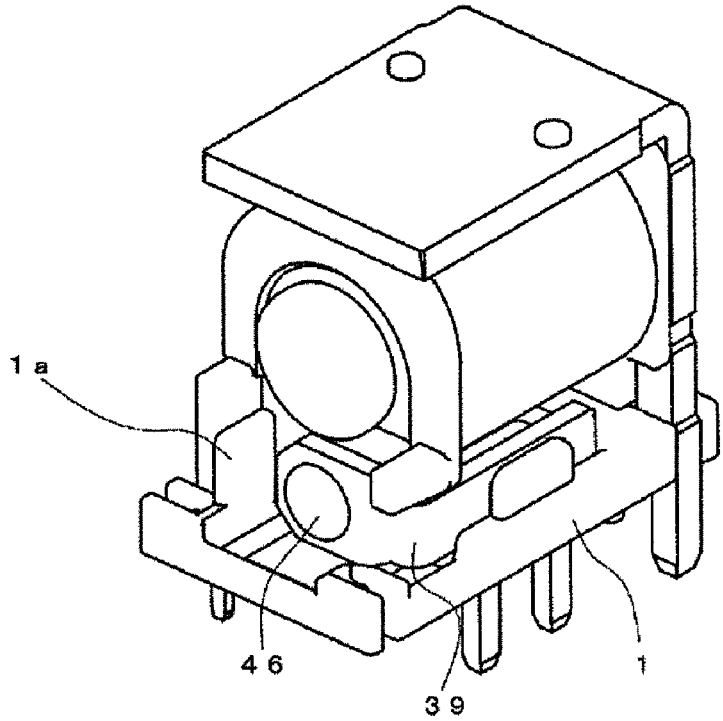
FIG. 8 is a partially perspective view illustrating a characteristic portion of an electromagnetic relay according to another embodiment of the invention.

FIG. 8 illustrates an example in which the guide unit is formed by part of the base 1.

In the base 1, a guide wall 1*a* is formed so as to extend from the upper surface of the base 1 toward the side region of the operating range of the movable touch piece 38.

Figure 9:
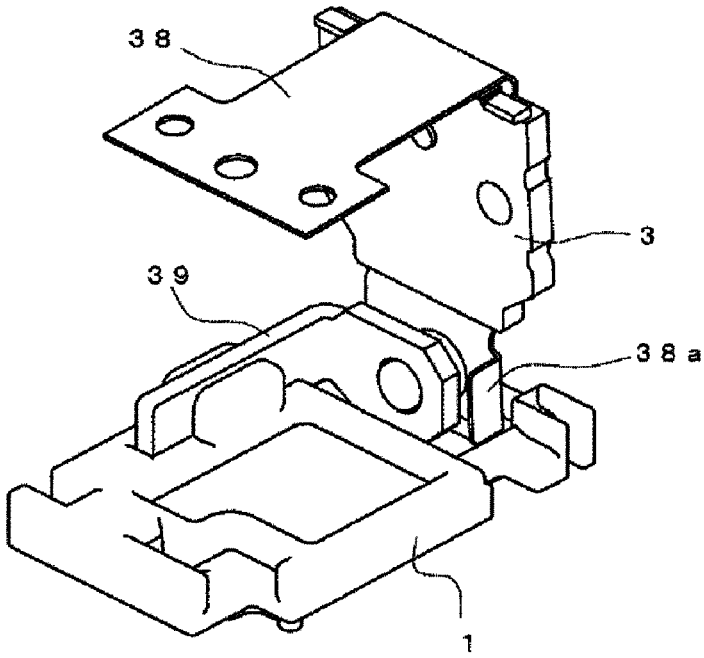
FIG. 9 is a partially perspective view illustrating a characteristic portion of an electromagnetic relay according to another embodiment of the invention.

FIG. 9 illustrates an example in which the guide unit is formed by part of the movable touch piece 38.

In the movable touch piece 38, a guide piece 38*a* is formed such that one of side edge portions of the movable contact portion is bent at substantially right angle toward the side of the opposite fixed terminal 39.

Figure 10:
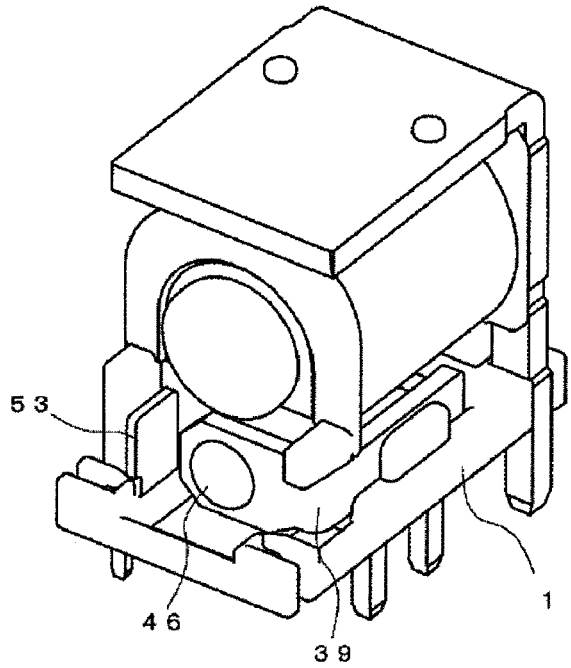
FIG. 10 is a partially perspective view illustrating a characteristic portion of an electromagnetic relay according to another embodiment of the invention.

FIG. 10 illustrates an example in which the guide unit is formed by a separately-provided blade 53.

For example, a plate made of the synthetic resin material or metallic material can be used as a blade 53, and the blade 53 is located in the side region of the operating range of the movable touch piece 38 by press-fitting the blade 52 in a recess (or rectangular hole) formed in the base 1.

Figure 11:
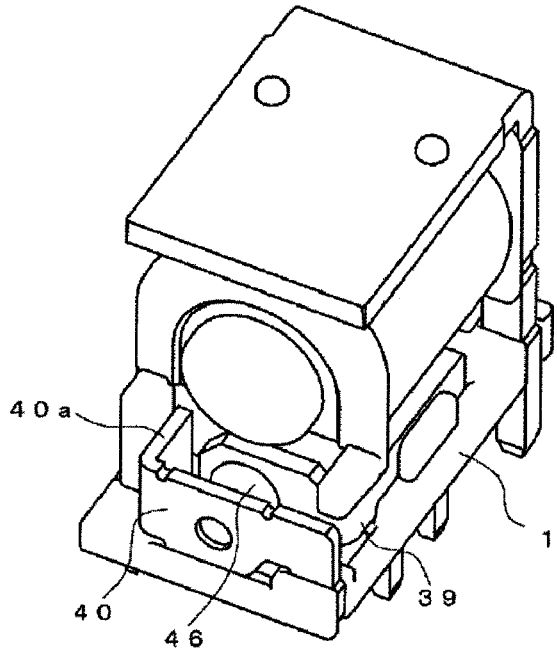
FIG. 11 is a partially perspective view illustrating a characteristic portion of an electromagnetic relay according to another embodiment of the invention.

FIG. 11 illustrates an example in which the guide unit is formed by part of the dummy terminal 40.

One end side of the dummy terminal 40 is bent along with the second leg 50 to form the guide unit 40*a* that is located in the side region of the operating range of the movable touch piece 38.

Figure 12:
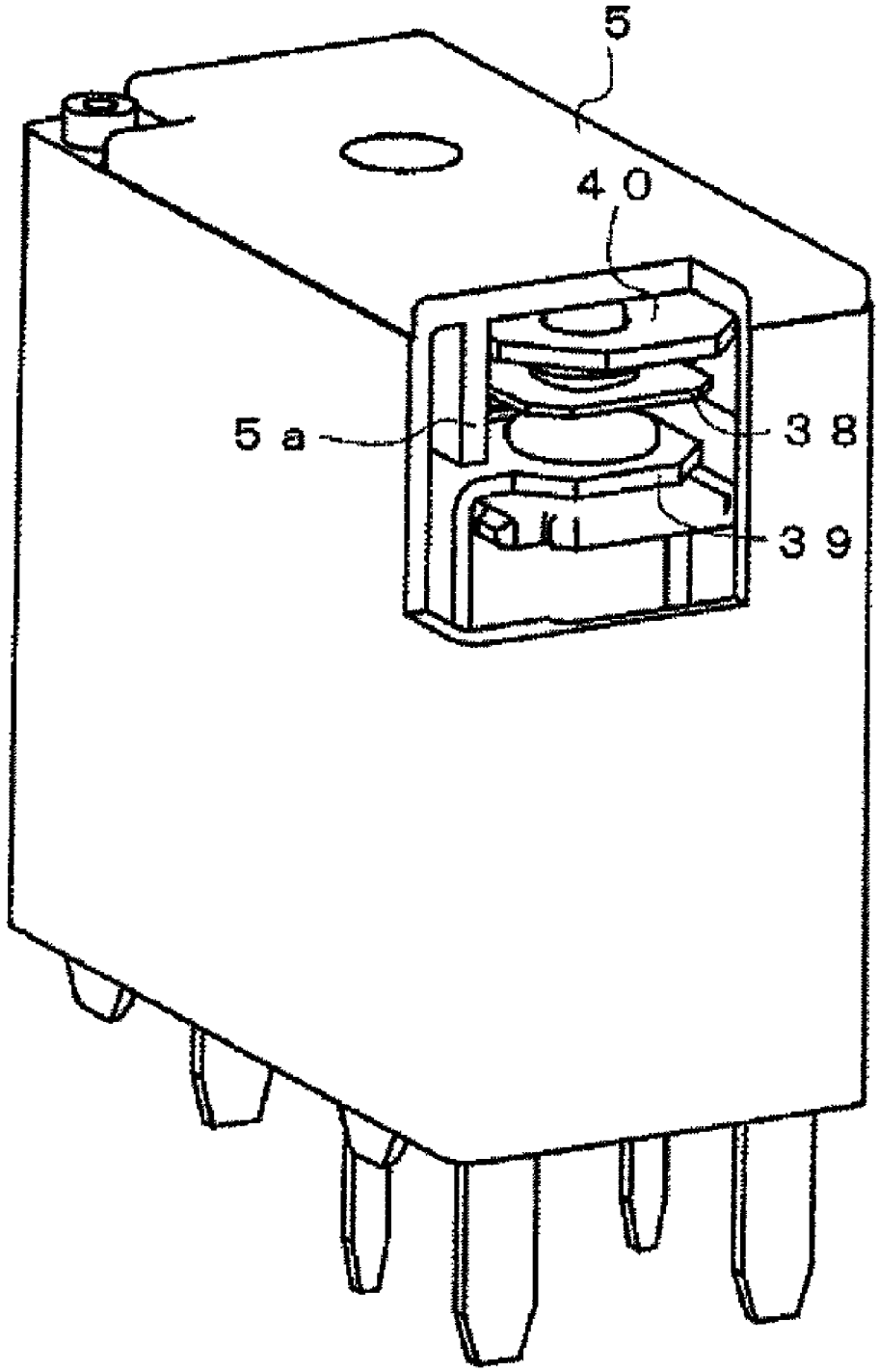
FIG. 12 is a partially perspective view illustrating a characteristic portion of an electromagnetic relay according to another embodiment of the invention.

FIG. 12 illustrates an example in which the guide unit is formed by part of the case 5.

In one or more embodiments of the present invention, the contact switching is performed beside the electromagnet unit 2. On the other hand, when the contact switching is performed above the electromagnet unit 2, a guide wall 5*a* can also be formed in the case 5.

The dummy terminal 40 is used in one or more embodiments of the present invention. Alternatively, a second fixed terminal (not illustrated) may be provided instead of the dummy terminal 40. In the second fixed terminal, the fixed contact 46 is swaged in the contact receiving portion 48 of the dummy terminal 40, and the leg extends downward. That is, the electric conduction state is established between the movable touch piece 38 and the second fixed terminal when the electromagnet unit 2 is in the demagnetized state, and the movable touch piece 38 switches the electric conduction state from the second fixed terminal to the first fixed terminal 39 by exciting the electromagnet unit 2. At this point, it is necessary that the movable contact 44 provided in the movable touch piece 38 be provided not only on the side of the fixed terminal 39 but also on the second fixed terminal side. It is necessary that the guide unit be provided beside not only the region where the movable contact 44 and the fixed contact 46 of the fixed terminal 39 are opened and closed but also the region where the movable contact 44 and the fixed contact of the second fixed terminal are opened and closed.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A contact switch structure comprising:

a touch piece;

a movable contact disposed on the touch piece;

a fixed contact disposed opposite the movable contact; and a guide unit that is provided in a side region with respect to an operating range of a movable touch piece to control an air flow, wherein the movable contact is opened and closed with respect to the fixed contact by operating the movable touch piece, and wherein a linear distance from the guide unit to an operating locus of the movable touch piece is 0.8 mm or less, and wherein said linear distance is less than a linear distance to a wall opposite the operating locus of the movable touch piece in a space formed between the movable touch piece and an opposite side of the guide unit.

2. The contact switch structure according to claim 1, wherein a linear distance to a wall opposite the operating locus of the movable touch piece in a space formed between the movable touch piece and an opposite side of the guide unit exceeds 0.8 mm.

3. An electromagnetic relay comprising:

a fixed contact;

a movable contact that is opened and closed with respect to a fixed contact;

an electromagnet unit comprising a coil wound around an iron core with a spool interposed therebetween through the coil to excite or demagnetize the electromagnet unit;

a movable iron piece that is turned to drive a movable touch piece by establishing or blocking electric conduction of the electromagnet unit; and a guide unit configured to control an air flow that is located in at least a side region with respect to an operating range of the movable touch piece, wherein a linear distance from the guide unit to an operating locus of the movable touch piece is 0.8 mm or less, and wherein said linear distance is less than a linear distance to a wall opposite the operating locus of the movable touch piece in a space formed between the movable touch piece and an opposite side of the guide unit.

4. The electromagnetic relay according to claim 3, wherein the guide unit is partially formed by a coil terminal attaching portion formed in a guard portion of the spool.

5. The electromagnetic relay according to claim 3, wherein a linear distance to a wall opposite the operating locus of the movable touch piece in a space formed between the movable touch piece and an opposite side of the guide unit exceeds 0.8 mm.

6. The electromagnetic relay according to claim 4, wherein a linear distance to a wall opposite the operating locus of the movable touch piece in a space formed between the movable touch piece and an opposite side of the guide unit exceeds 0.8 mm.

* * * * *